US008353584B2

(12) United States Patent
Yokoyama et al.

(10) Patent No.: US 8,353,584 B2
(45) Date of Patent: Jan. 15, 2013

(54) LIQUID DISCHARGING APPARATUS

(75) Inventors: Daisuke Yokoyama, Kawasaki (JP); Yasuyuki Tamura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 213 days.

(21) Appl. No.: 12/825,184

(22) Filed: Jun. 28, 2010

(65) Prior Publication Data

US 2010/0327025 A1 Dec. 30, 2010

(30) Foreign Application Priority Data

Jun. 30, 2009 (JP) ..... 2009-155676

(51) Int. Cl.

| | |
|---|---|
| ***B41J 2/18*** | (2006.01) |
| ***B41J 2/175*** | (2006.01) |
| ***B41J 29/38*** | (2006.01) |
| ***B41J 2/165*** | (2006.01) |

(52) U.S. Cl. ..... 347/89; 347/85; 347/6; 347/29

(58) Field of Classification Search ..... None
See application file for complete search history.

(56) References Cited

U.S. PATENT DOCUMENTS

| | | | | |
|---|---|---|---|---|
| 4,937,598 A | | 6/1990 | Hine | |
| 5,481,284 A | * | 1/1996 | Kitahara et al. | 347/42 |
| 6,106,108 A | * | 8/2000 | Cluet | 347/84 |
| 6,179,406 B1 | * | 1/2001 | Ito et al. | 347/35 |
| 7,494,211 B2 | * | 2/2009 | Murakami | 347/84 |
| 2002/0113845 A1 | * | 8/2002 | Yazawa et al. | 347/65 |
| 2006/0197812 A1 | * | 9/2006 | Murakami et al. | 347/84 |

FOREIGN PATENT DOCUMENTS

| | | | |
|---|---|---|---|
| JP | 06008465 A | * | 1/1994 |
| JP | 2006-88575 | | 4/2006 |

* cited by examiner

*Primary Examiner* — Stephen Meier
*Assistant Examiner* — Leonard S Liang
(74) *Attorney, Agent, or Firm* — Canon USA Inc IP Division

(57) ABSTRACT

A liquid discharging apparatus in which a liquid is flowed in one direction in a circulation flow path at the time of non-discharge, and the flow path is refilled with liquid from both directions at the time of discharge. The liquid discharging apparatus includes a pressure adjustment unit that satisfies a condition "Pu>Pd, Pn>−Pd", where Pu denotes a fluid pressure at a predetermined position on the upstream side of a discharge port, Pd denotes a fluid pressure at a predetermined position on the downstream side thereof, and Pn denotes a pressure equivalent to a capillary force of the discharge port for absorbing the liquid from the flow path into the discharge port immediately after the liquid has been discharged therefrom.

5 Claims, 14 Drawing Sheets

LIQUID DISCHARGING APPARATUS

BACKGROUND OF THE INVENTION

1. Field of the Invention

The present invention relates to a liquid discharging apparatus having a circulating flow path.

2. Description of the Related Art

A head of a liquid discharging apparatus is known, which utilizes a piezo-electric element (PZT) or a heater (heating element) as an energy generating element, which generates energy for discharging a liquid. When such a liquid discharging apparatus is left for a long period of time without liquid discharge, a liquid in the vicinity of a discharge port dries, increases in viscosity, or solidifies to cause clogging of the discharge port, adversely affecting the discharge of droplets.

A cap mechanism is known for sealing the discharge port face with a cap to prevent the liquid in the vicinity of the discharge port from drying. However, such a conventional cap mechanism has its limits in preventing clogging of the discharge port by the dryness of the liquid at a position where it contacts the atmosphere in the vicinity of the exit of the discharge port.

Japanese Patent Application Laid-Open No. 2006-88575 and U.S. Pat. No. 4,937,598 discusses a circulating flow path having a discharge port midway thereof and in which a liquid flows from the upstream side to the downstream side, and in which liquid circulation in the flow path prevents the liquid in the vicinity of the discharge port from drying.

However, the techniques discussed in Japanese Patent Application Laid-Open No. 2006-88575 and U.S. Pat. No. 4,937,598 assume only one direction of liquid flow, and the liquid on the downstream side of the energy generating element further flows only toward the downstream side. Therefore, the techniques have a large energy loss because the liquid is circulated so as to overcome the refill by a capillary force from the downstream side of the energy generating element after liquid discharge.

If air bubbles or dust enters the flow path, sending the liquid at such a very high flow velocity in this way may remarkably vary the flow velocity, and largely fluctuate the pressure at the discharge port. There has been a concern that this phenomenon adversely affects the discharge performance. There has been another concern that supplying the liquid only from one direction to the energy generating element may cause an offset in discharging direction, resulting in image quality degradation by deviation between impact positions of the main droplet and the sub droplet following the main droplet.

SUMMARY OF THE INVENTION

The present invention is directed to a liquid discharging apparatus capable of ensuring a highly reliable discharge state while restraining thickening and solidification of a liquid due to the evaporation of the liquid.

According to an aspect of the present invention, a liquid discharging apparatus includes a liquid container configured to contain a liquid, an energy generating element used to discharge the liquid from a discharge port, a supply flow path configured to supply the liquid from the liquid container to the energy generating element, a collecting flow path configured to collect the liquid from the energy generating element into the liquid container, and a pressure adjustment unit configured to adjust Pu and Pd so that a condition "Pu>Pd, Pn>−Pd" is satisfied, where Pu denotes a pressure in the flow path on the upstream side of the energy generating element, Pd denotes a pressure in the flow path on the downstream side of the energy generating element, and Pn denotes a pressure equivalent to a capillary force for refilling the flow path with the liquid when the liquid has been discharged from the discharge port.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Figure 1:
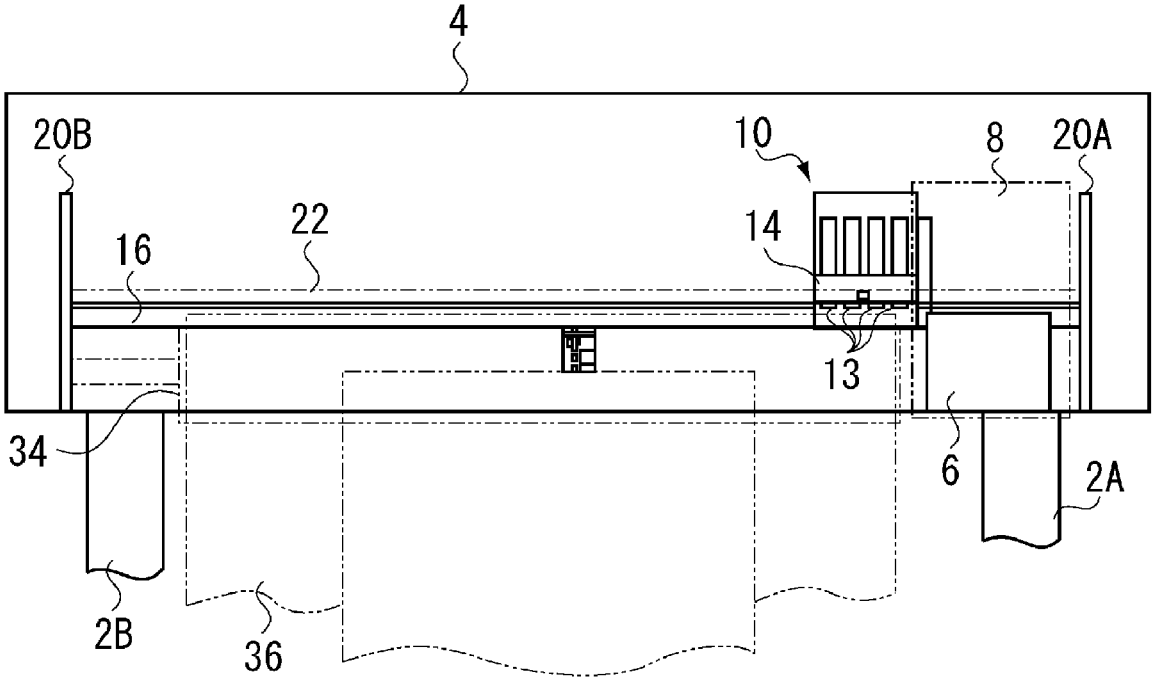
FIG. 1 is an elevational view illustrating an overall configuration of a liquid discharging apparatus according to the present invention.

Various exemplary embodiments, features, and aspects of the invention will be described in detail below with reference to the drawings.

In the present specification, a negative pressure refers to a gauge pressure, and the atmospheric pressure is assumed to be zero and a pressure lower than the atmospheric pressure is represented as a negative pressure. The upstream side refers to the side on which the liquid is supplied from a liquid container to a head. The downstream side is the side on which the liquid coming from the head is collected into the liquid container.

A liquid discharging apparatus according to the present invention includes a circulating flow path in which a liquid circulates. At the time of non-discharge, the liquid flows in one direction. In the refilled state after liquid discharge, the liquid is supplied to the discharge port from both directions (upstream side and downstream side) of the flow path on which the energy generating element is disposed.

Forces applied to the liquid in the flow path in the head of the liquid discharging apparatus according to the present exemplary embodiment will be described below. The forces applied to the liquid satisfies a condition "Fn>Fd>Fu", where Fd denotes a pressure force applied in the downstream direction by a pressure adjustment unit to be described below, Fu denotes a pressure force applied in the upstream direction by the pressure adjustment unit, and Fn denotes a pressure force applied in the refill direction equivalent to a capillary force for refilling the flow path with liquid after liquid discharge.

At the time of non-discharge, since the flow path in the vicinity of the discharge port is fully filled with liquid, the forces applied to the liquid satisfies a condition "Fn=0, Fd>Fu", resulting in a liquid flow in the downstream direction. On the other hand, when the energy generating element is driven to discharge the liquid between the energy generating element and the discharge port, the flow path is refilled with liquid therearound so as to compensate the discharged liquid. In this case, since the forces applied to a meniscus in the flow path immediately after discharge satisfies a condition "Fn>Fd>Fu", the flow path is refilled with liquid from both the upstream and downstream directions.

When refill is completed and the flow path is refilled with liquid, the force applied to the liquid in the flow path satisfies a condition "Fn=0, Fd>Fu", resulting in a liquid flow in the downstream direction.

A relation between the pressure applied to the liquid in each flow path and the pressure equivalent to the capillary force for satisfying the above-described relational formula will be described below. A pump and a negative-pressure maintenance apparatus as a pressure adjustment unit for attaining these pressures will also be described below.

The inside of the circulating flow path is subjected to the following three pressures: a pressure Pu applied to the liquid in the flow path disposed on the upstream side of the energy generating element, a pressure Pd applied to the liquid in the flow path disposed on the downstream side of the energy generating element, and a pressure Pn equivalent to the capillary force for refilling the flow path with liquid at the time of discharge from the discharge port.

Since the pressure Pn is equivalent to the capillary force, it is constantly a positive pressure. Since liquid flows from higher to lower pressure portion, the pressures applied to the liquid in the flow path is set so that a condition "Pu>Pd" is satisfied regardless of the positive or negative pressure. The flow path is not limited to the flow path in the head. The flow path disposed on the upstream side refers to the flow path from the negative-pressure maintenance apparatus to the discharge port, and the flow path disposed on the downstream side refers to the flow path from the discharge port to the liquid container. Pressures in the flow path will be described below for each pressure condition.

(1. Pu≦0, Pd<0)

A condition is considered which enables liquid circulation at the time of non-discharge as well as refill from both directions at the time of discharge, when the liquid in the flow path is maintained at a negative pressure (Pu≦0, Pd<0) to prevent leak from the discharge port.

Figure 5A:
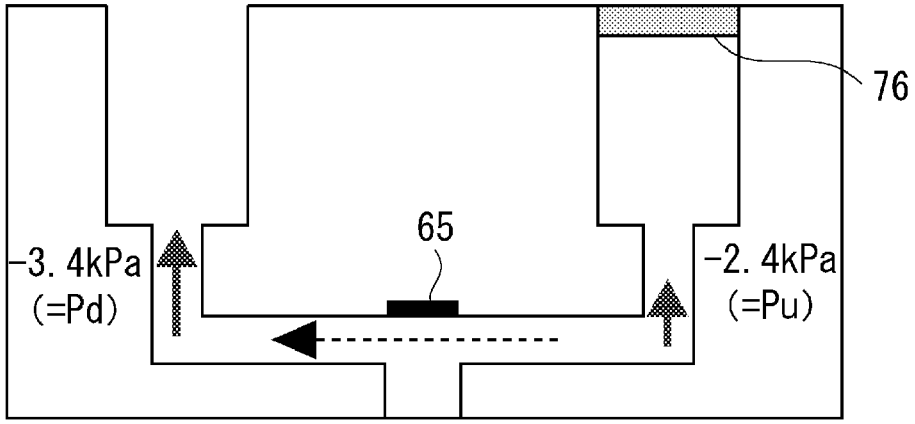
FIGS. 5A and 5B are cross-sectional schematic views of the head after liquid discharge according to the first exemplary embodiment.
Figure 5B:
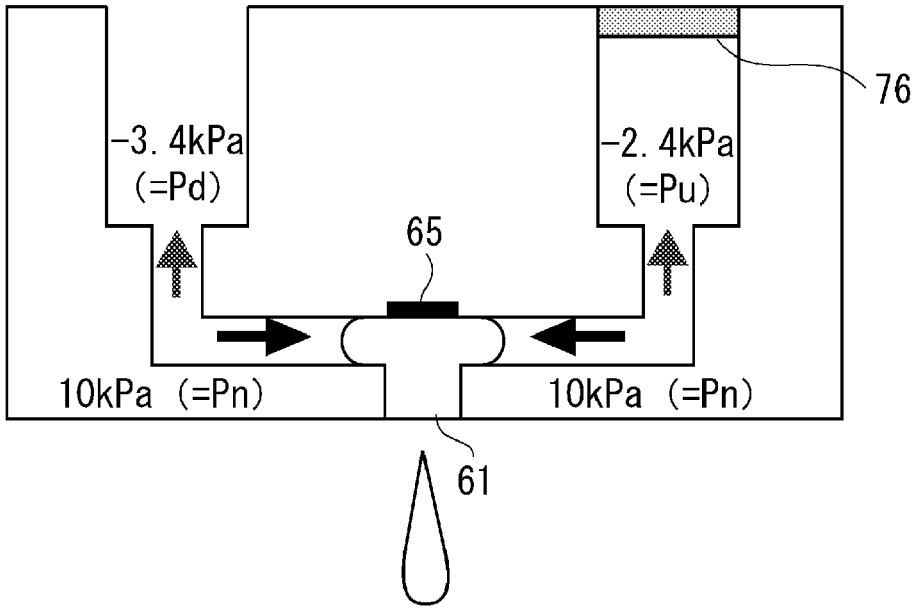

FIGS. 5A and 5B are schematic views of the liquid discharging head. FIG. 5A illustrates a state of the liquid discharging head at the time of non-discharge, and FIG. 5B illustrates a state thereof after the time of discharge. At the time of non-discharge as illustrated in FIG. 5A, the pressures applied to the liquid in the flow path satisfy a condition "Pu>Pd(|Pu|<|Pd|)". Therefore, a pressure force pulling the liquid from the downstream side becomes larger than a pressure force pulling it from the upstream side, resulting in a liquid flow in the direction illustrated by the dotted-line arrow.

After liquid discharge as illustrated in FIG. 5B, the pressure Pn equivalent to the capillary force is generated while a condition "Pu>Pd" is satisfied, resulting in a condition "Pn>−Pd(Pn>|Pd|)". Specifically, on the downstream side of the energy generating element, the pressure force applied in the refill direction is larger than the pressure force pulling the liquid in the downstream direction, resulting in refill from the downstream side.

Similarly, when a condition "Pn>−Pu(Pn>|Pu|)" is satisfied also on the upstream side of the energy generating element, the pressure force applied in the refill direction is larger than the pressure force pulling the liquid in the upstream direction, resulting in refill also from the upstream side.

(2. Pu>0, Pd≦0)

A condition is considered for enabling liquid circulation at the time of non-discharge as well as refill from both directions at the time of discharge, when a positive pressure is applied from the upstream side of the energy generating element in such a manner that the liquid does not leak from the discharge port, and a negative pressure is applied from the downstream side thereof (Pu>0, Pd≦0).

At the time of non-discharge, since the pressures applied to the liquid in the flow path satisfy a condition "Pu>Pd", the liquid is pulled from the downstream side and pushed from the upstream side, resulting in a liquid flow from the upstream side to the downstream side. After liquid discharge, the pressure Pn equivalent to the capillary force is generated while satisfying a condition "Pu>Pd", resulting in a condition "Pn>−Pd(Pn>|Pd|)."

Specifically, on the downstream side of the energy generating element, the pressure force in the refill direction is larger than the pressure force pulling the liquid in the downstream direction, resulting in refill from the downstream side. On the upstream side of the energy generating element, since the refill direction coincides with the direction of the pressure applied from the upstream side, resulting in refill also from the upstream side.

(3. Pu≦0, Pd>0)

This condition does not satisfy the condition "Pu>Pd" of the present invention, resulting in a liquid flow from the downstream side to the upstream side. Therefore, the present invention does not include this condition.

(4. Pu>0, Pd≧0)

A condition is considered for enabling liquid circulation at the time of non-discharge as well as refill from both directions at the time of discharge, when a positive pressure is applied from both the upstream and downstream sides of the energy generating element such that the liquid does not leak from the discharge port (Pu>0, Pd≧0).

At the time of non-discharge, since the pressures applied to the liquid in the flow path satisfy a condition "Pu>Pd", the pressure force pushing the liquid from the upstream side is larger than the pressure force pushing it from the downstream side, resulting in a liquid flow from the upstream side to the downstream side. After liquid discharge, although the pressure Pn equivalent to the capillary force is generated while satisfying a condition "Pu>Pd", the direction in which the capillary force acts coincide with the direction of the pressure applied to the liquid, resulting in refill from both directions.

When above-described conditions are summarized, the following formula (1) is given.

$$Pu>Pd,\ Pn>-Pd \text{ (where the atmospheric pressure is 0)} \quad (1)$$

A phenomenon, after liquid is discharged from the discharge port, that liquid gets together from the flow path in the vicinity of the discharge port to supplement the discharged liquid is referred to as refill. The refill force Pn after liquid discharge, i.e., the capillary force that pulls the liquid up to the vicinity of the exit of a discharge port 61 can be calculated by the following formula (2) based on the physical characteristics of the liquid and the surface property and dimensions of the flow path.

$$Pn=2T\cos\theta/\rho gr \quad (2)$$

where T denotes the surface tension, θ denotes the angle of contact, ρ denotes the liquid density, g denotes the acceleration of gravity, and r denotes the inner diameter of the tube.

FIG. 1 illustrates an exemplary liquid discharging apparatus according to the present invention. A housing 4 is connected to and supported on top ends of two supports 2A and 2B facing each other. The housing 4 includes two support plates 20A and 20B facing each other, disposed apart at a predetermined distance. A carriage rail member 16 for slidably supporting a carriage 14 is provided between the support plates 20A and 20B.

The carriage rail member 16 is disposed so that its central axis line becomes substantially parallel to the central axis line of a conveyance roller 34 to be described below. Specifically, the carriage rail member 16 is supported by the support plates 20A and 20B in a direction substantially perpendicular to the conveyance direction of a recording material 36 as a recording medium.

A head 13 to be described below is mounted on the carriage 14. Each of yellow, magenta, cyan, and black ink is supplied to the head 13 via a tube. Recording operation of the head 13 is controlled at a predetermined timing in response to a drive pulse signal formed based on image data transmitted from a head control unit (not illustrated).

The carriage 14 is reciprocally moved at a predetermined timing. The carriage 14 is movably guided by the carriage rail member 16 and a roller guide rail 22. A waiting area unit 8 is provided at a position between the end of the recording material 36 on the side of the support plate 20A and the support plate 20A. The carriage 14 can wait at the waiting area unit 8.

A recovery processing unit 6 for performing predetermined recovery processing for the head 13 is provided on the waiting area unit 8. The recovery processing unit 6 is disposed facing the discharge port face of the head 13, and has a known structure including the capping mechanism for selectively covering the discharge port face and absorbing liquid. The recovery processing unit 6 is controlled based on a drive control signal supplied at a predetermined timing from a recovery processing drive control unit (not illustrated).

Figure 2:
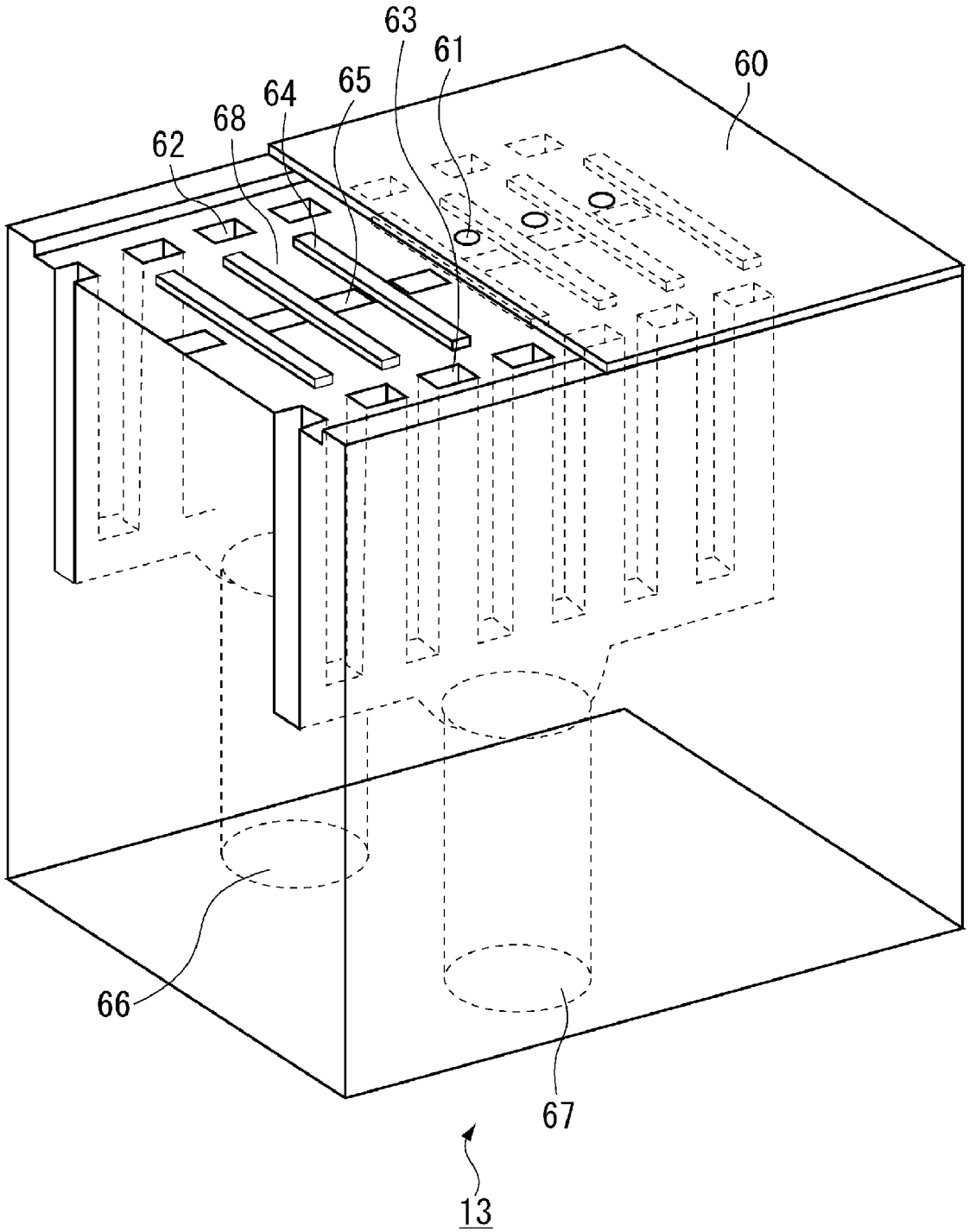
FIG. 2 is a perspective view illustrating an overall configuration of a head according to the present invention.

FIG. 2 is a detail view of the head 13 of the liquid discharging apparatus according to the present invention. An orifice plate 60 and a structure directly thereunder form a liquid chamber as a part of the flow path. The liquid supplied into the liquid chamber is discharged from a discharge port 61 formed on the orifice plate 60. An intra-head supply flow path 66 supplies a liquid such as ink from a liquid container (tank) to be described below.

The liquid is supplied into the liquid chamber via an inlet 62 communicating with the intra-head supply flow path 66, and then branched into an individual flow path 68 partitioned by a flow path wall 64 for each discharge port. An intra-head collecting flow path 67 collects the liquid into the liquid container. Liquid flows in the individual flow path 68, passes through an outlet 63 and the intra-head collecting flow path 67, and exits the head 13.

Each individual flow path 68 is provided with an energy generating element 65 directly under the discharge port 61, and the liquid is filed out from the discharge port 61 by the film boiling phenomenon. Although ordinary ink is applicable, the liquid discharged in the present exemplary embodiment has a high viscosity between 5 cP and 100 cP, preferably between 5 cP and 60 cP. In comparison with ordinary ink, a high-viscosity liquid noticeably causes a problem that the discharge port is clogged by the evaporation of the liquid in the vicinity of the discharge port 61.

Figure 3:
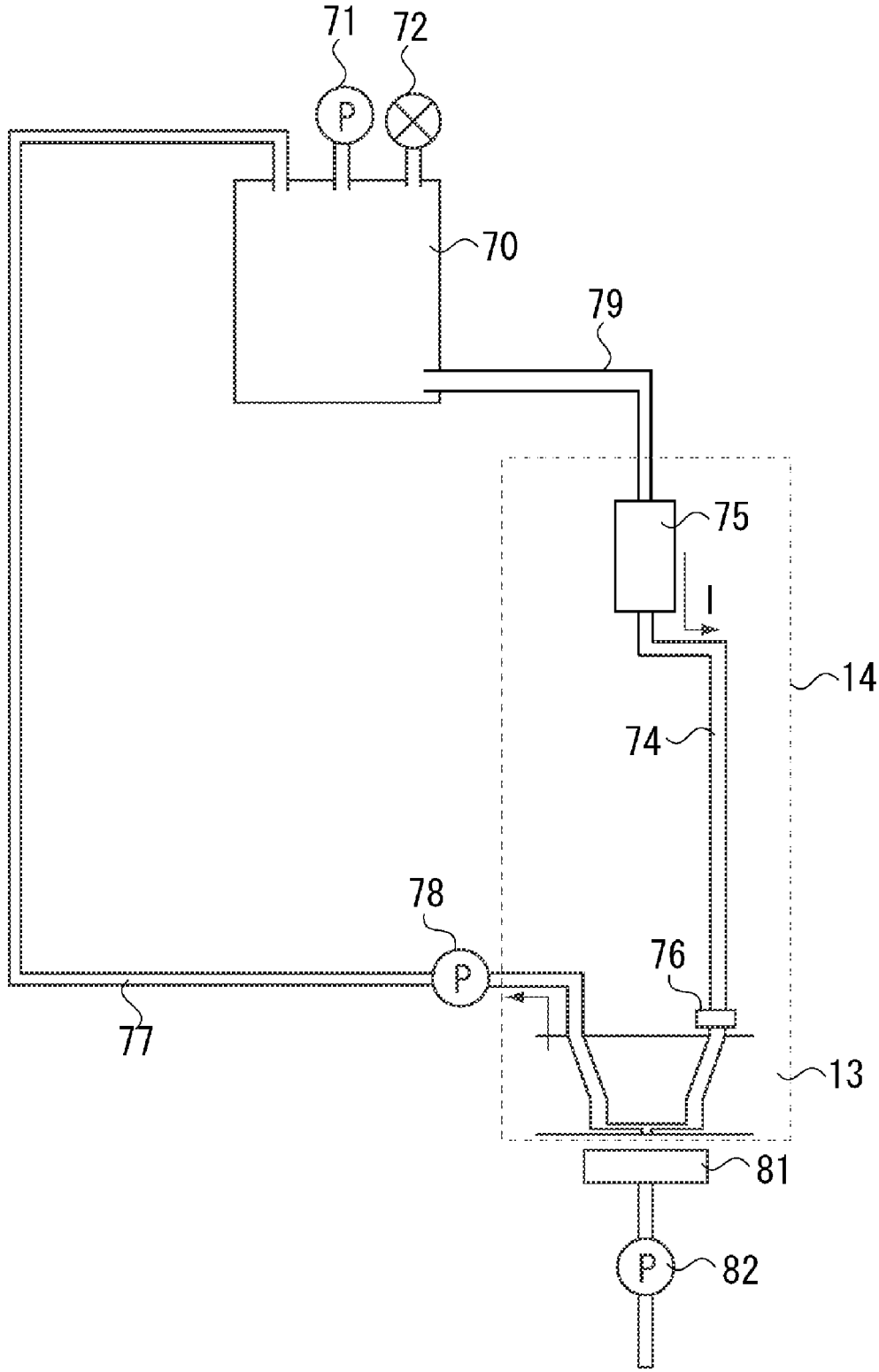
FIG. 3 illustrates a flow path configuration according to a first exemplary embodiment.

FIG. 3 illustrates a flow path configuration of the liquid discharging apparatus with respect to one liquid type. A liquid container 70 containing a liquid is provided with a pump 71 and a release valve 72. Liquid is supplied from the liquid container 70 to a first supply flow path 79.

The first supply flow path 79 is connected to a second supply flow path 74 via a negative-pressure maintenance apparatus 75 to be described below. A filter 76 for preventing dust from entering the head 13 is provided between the second supply flow path 74 and the head 13. Liquid flows in the second supply flow path 74, passes through the filter 76, and enters the intra-head supply flow path 66 (FIG. 2) in the head 13.

The liquid circulates in the head 13, passes through the intra-head collecting flow path 67 (FIG. 2), and exits from the head 13. The intra-head collecting flow path 67 is connected to the collecting flow path 77. The liquid is returned to the liquid container 70 by driving a pump 78 provided in the collecting flow path 77.

The first supply flow path 79, the second supply flow path 74, and the intra-head supply flow path 66 supply liquid from the liquid container 70 toward the energy generating element 65. The intra-head collecting flow path 67 and the collecting flow path 77 collect liquid from the energy generating element 65 toward the liquid container 70.

In the present exemplary embodiment, the negative-pressure maintenance apparatus 75, the filter 76, and the head 13 are mounted on the carriage 14. This is because disposing the negative-pressure maintenance apparatus 75 and the head 13 in the vicinity of each other facilitates the management of negative pressures. However, the negative-pressure maintenance apparatus 75 may not be mounted on the carriage 14.

A head cap 81 contacts the orifice plate 60 of the head 13. A liquid suction pump 82 generates a negative pressure in the head cap 81.

Figure 6:
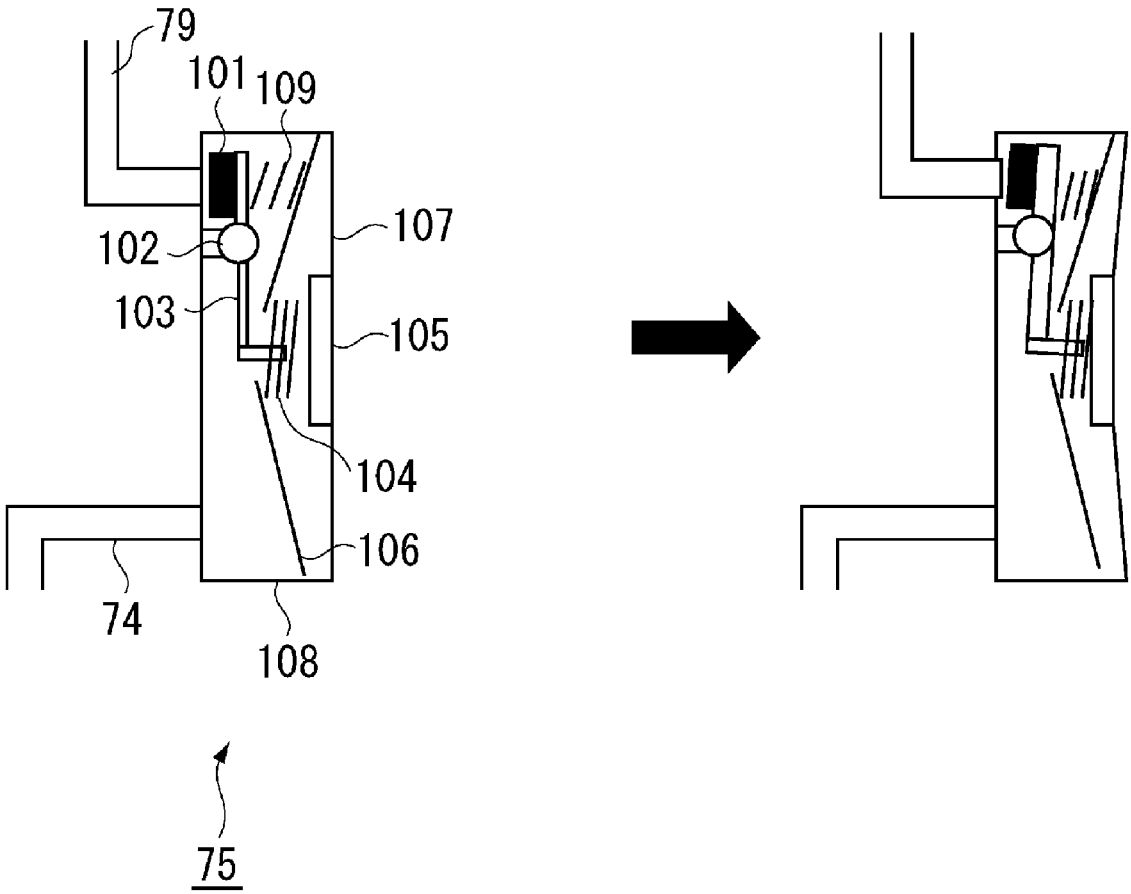
FIG. 6 illustrates an internal structure of a negative-pressure maintenance apparatus.

FIG. 6 illustrates an internal structure of the negative-pressure maintenance apparatus 75. A flexible film 107 is stuck on apart of a hollow hard case 108 to form a closed space. A member 105 bonded on the flexible film 107 by heat adhesion is movable to such a direction that changes the capacity of the closed space by the flexibility of the flexible film 107. Referring to FIG. 6, the member 105 moves approximately laterally.

When the flexible film 107 moves in such a direction that reduces the capacity of the closed space, the member 105 compresses a spring 104. When the spring 104 is compressed, the member 105 presses an arm 103. The spring 104 is supported by a partitioning wall 106 for partitioning the closed space in the negative-pressure maintenance apparatus 75 and the member 105. The partitioning wall 106 may not completely partition the hard case 108 but preferably support the spring 104 and a compression spring 109 to be described below.

The arm 103 is rotatable centering on a supporting point 102. A negative-pressure valve 101 made of an elastic member such as rubber is provided on the side opposite to the side on which the arm 103 contacts the member 105. The negative-pressure valve 101 is disposed at a position where the negative-pressure maintenance apparatus 75 and the first supply flow path 79 are connected.

The negative-pressure valve 101 is biased by the compression spring 109 in such a direction that disables the connection between the first supply flow path 79 and the negative-pressure maintenance apparatus 75. In association with the movement of the member 105 accompanying the deformation of the flexible film 107, the negative-pressure valve 101 enables and disables communication between the first supply flow path 79 and the negative-pressure maintenance apparatus 75. The compression spring 109 is supported by the partitioning wall 106.

The above-described configuration of the negative-pressure maintenance apparatus 75 enables maintaining almost constant the negative pressure of the second supply flow path 74 connecting the negative-pressure maintenance apparatus 75 and the head 13 even when liquid is supplied by pressurization from the first supply flow path 79 to the negative-pressure maintenance apparatus 75.

Operations of the negative-pressure maintenance apparatus 75 will be described below. In the initial state, the flow path is filled with liquid. When the release valve 72 of the liquid container 70 is closed and the pump 71 is operated at the time of liquid discharge, the first supply flow path 79 between the liquid container 70 and the negative-pressure maintenance apparatus 75 is pressurized. With this pressure force, however, the negative-pressure valve 101 does not open against the compression spring 109 of the negative-pressure maintenance apparatus 75.

Then, when liquid is kept being discharged from the discharge port 61, the negative pressure in the negative-pressure maintenance apparatus 75 connecting to the second supply flow path 74 increases. Accordingly, the flexible film 107 moves so as to reduce the capacity of the negative-pressure maintenance apparatus 75 to compress the spring 104 via the member 105.

When liquid is further kept being discharged from the discharge port 61 and the negative pressure in the negative-pressure maintenance apparatus 75 exceeds a certain fixed value, the member 105 contacts the arm 103 and the arm 103 rotates centering on the supporting point 102. Thus, the negative-pressure valve 101 opens against the compression spring 109.

Accordingly, liquid is supplied from the first supply flow path 79 into the negative-pressure maintenance apparatus 75, resulting in reduced negative pressure in the negative-pressure maintenance apparatus 75. Repeating the above-described process enables maintaining almost constant the negative pressure in the negative-pressure maintenance apparatus 75 and the negative pressure in the second supply flow path 74. At the time of non-discharge, these negative pressures are maintained at the same level as those at the time of discharge.

Operations of the liquid discharging apparatus according to the present exemplary embodiment will be described below with reference to FIGS. 3 to 5.

Referring to FIG. 3, to fill the head 13 with liquid such as ink, the pump 78 on the downstream side of the head 13 is operated. A diaphragm pump or a Corro pump is used as the pump 78. Alternatively, the pump 71 disposed at the liquid container 70 is used to fill the head 13 with liquid by pressurization.

In this case, a pressure force is applied so that the negative-pressure valve 101 is opened. In any case, by releasing the pressure by the release valve 72 of the liquid container 70, all flow paths ranging from the first supply flow path 79 through the negative-pressure maintenance apparatus 75, the second supply flow path 74 up to the head 13 are filled with the liquid from the liquid container 70.

After all flow paths has been filled with liquid, the pump 71 is operated to cause pressurization in the negative-pressure maintenance apparatus 75 to control the pressure in the first supply flow path 79 to a predetermined value. It is preferable to turn the pump 71 ON or OFF and open and close the release valve 72 based on the pressure measured by a pressure gauge (not illustrated) provided in the first supply flow path 79.

Further, the pump 78 is operated to produce a flow for returning liquid to the liquid container 70 via the collecting flow path 77. As a result, a circulating flow path as illustrated by the arrow in FIG. 3 is formed. Thus, the pressure adjustment unit according to the present exemplary embodiment includes a set of the negative-pressure maintenance apparatus 75 and the pump 78 to control the pressure in the flow path.

Figure 4:
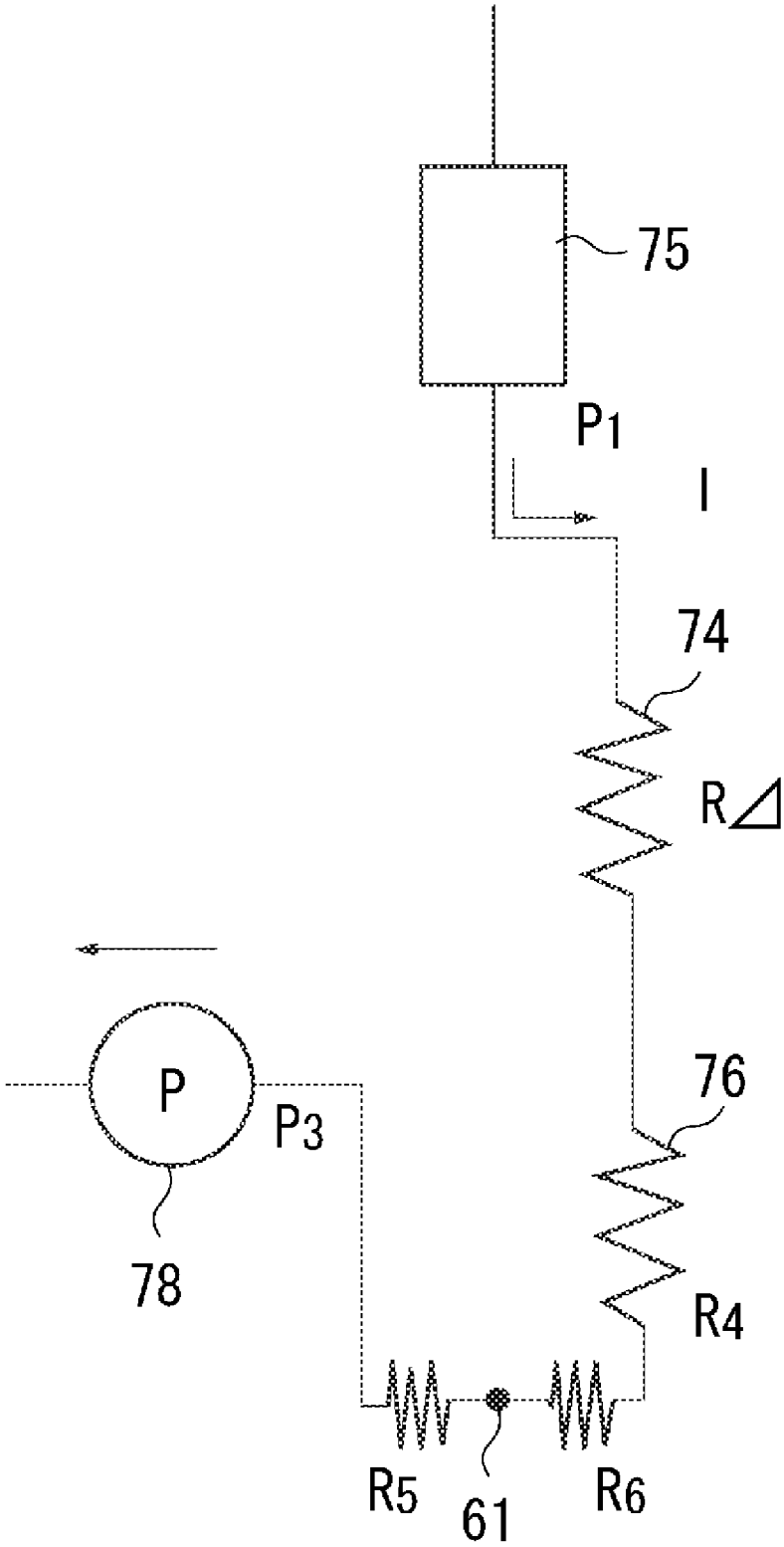
FIG. 4 illustrates flow path resistances according to the first exemplary embodiment.

FIG. 4 schematically illustrates flow path resistances by the flow path configuration according to the present exemplary embodiment. A flow rate I is represented by the following formula (3):

$$I=(P_3-P_1)/(R_4+R_5+R_6+R_\Delta) \quad (3)$$

where I denotes the total flow rate of the individual flow paths 68, $R_4$ denotes the flow path resistance of the filter 76, $R_5$ denotes the flow path resistance of the individual flow path in the head on the downstream side of the discharge port 61, $R_6$ denotes the flow path resistance of the individual flow path in the head on the upstream side of the discharge port 61, $R_\Delta$ denotes the flow path resistance of the flow path 74, $P_1$ denotes the pressure (Pu) on the downstream side in the vicinity of the negative-pressure maintenance apparatus 75, and $P_3$ denotes the pressure (Pd) on the upstream side in the vicinity of the pump 78.

Actual flow path resistances and dimensions of the liquid discharging apparatus are assigned to formula (3). In the present exemplary embodiment, a sufficient flow velocity for restraining the dryness in the vicinity of the discharge port 61 is set to 0.16 [mm/sec] and a sufficient flow rate I therefor is set to 6 [μl/min]. Each individual flow path 68 in the head 13 is made of a circular tube having a diameter and a length of approximately Φ20 [μm] and 1=200 [μm], respectively. The head 13 includes a thousand individual flow paths 68 for each color. Through measurement, $R_4$=0.17 [kPa*min/μl] was obtained. Through calculation by the Poisson's law, $R_5+R_6=7.56\times10-4$ [kPa*min/μl] was obtained. Through measurement, RΔ=1.81×10−6 [kPa*min/μl] was obtained.

In the present exemplary embodiment, the pump 78 was driven to achieve $P_3$=−3.4 [kPa] and the negative-pressure maintenance apparatus 75 was adjusted to achieve $P_1$=−2.4 [kPa] as values satisfying formulas (1) and (3). On the other hand, the capillary force serving as the refill force after liquid discharge can be calculated to about 10 [kPa] by formula (2), depending on the physical characteristics of the liquid and the above dimensions of the flow path.

Therefore, at the time of non-discharge, the liquid in the flow path is pulled in the downstream direction by a pressure force of −3.4 [kPa] (=Pd) and in the upstream direction by a pressure force of −2.4 [kPa] (=Pu), as illustrated in FIG. 5A. Since there is a relation Pu>Pd, the liquid flows from the upstream side to the downstream side.

At the time of refill after discharge, although the liquid in the flow path is pulled in the downstream direction by a pressure force of −3.4 [kPa] (=Pd) and in the upstream direction by a pressure force of −2.4 [kPa] (=Pu), it is pulled at the same time toward the side of the discharge port 61 by a pressure force of 10 [kPa] (=Pn), as illustrated in FIG. 5B.

Specifically, since the refill force is larger than the pressure force pulling liquid from the upstream and downstream sides satisfying formula (1), the flow path is refilled with liquid not only from the upstream side of the energy generating element but also from the downstream side thereof.

Further, in the present exemplary embodiment, since the inside of the flow path is maintained at a negative pressure, ink leak from the discharge port 61 can also be suitably restrained.

In a second exemplary embodiment, the second supply flow path 74 for supplying liquid from the liquid container to the head is branched to a first branch flow path 74*a* and a second branch flow path 74*b*. The negative-pressure maintenance apparatus 75 is disposed between the first supply flow path 79 and a branch point of the first branch flow path 74*a* and the second branch flow path 74*b*. Description of operations will be omitted since the configuration of the present exemplary embodiment is similar to that of the first exemplary embodiment.

Figure 7:
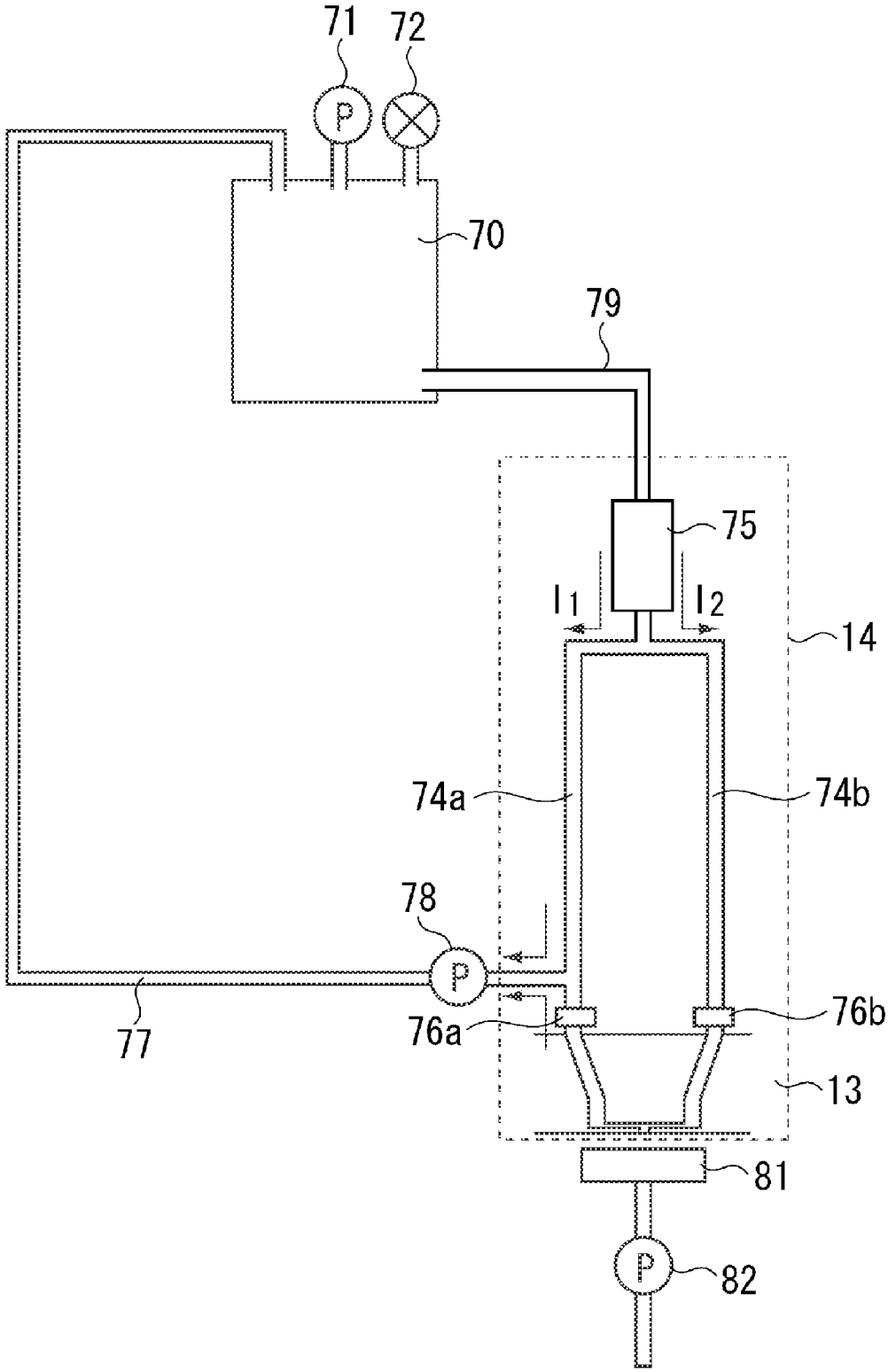
FIG. 7 illustrates a flow path configuration according to a second exemplary embodiment.

FIG. 7 illustrates a flow path configuration of a liquid discharging apparatus according to the present exemplary embodiment with respect to one liquid type. Liquid is supplied from the liquid container 70 to the first supply flow path 79. The liquid supplied to the first supply flow path 79 passes through the negative-pressure maintenance apparatus 75 and then branches to the first branch flow path 74*a* and the second branch flow path 74*b*.

The flow rate is divided into flow rates $I_1$ and $I_2$ according to the flow path resistance of each of the first branch flow path 74*a* and second branch flow path 74*b*. Filters 76*a* and 76*b* for preventing dust from entering the head 13 are provided between the branch flow paths 74*a* and 74*b* and the head 13, respectively. Liquid flows in the second branch flow path 74*b*, passes through the filter 76*b*, and enters the intra-head supply flow path 66 (FIG. 2) in the head 13.

After circulating in the head 13, the liquid passes through the intra-head collecting flow path 67 (FIG. 2) and the filter 76*a*, and then exits from the head 13. The flow path exiting the head 13 is joined with the first branch flow path 74*a* and then connected to the collecting flow path 77. The liquid is returned to the liquid container 70 by driving the pump 78 provided in the collecting flow path 77.

Operation for filling the head 13 with liquid is similar to that in the first exemplary embodiment. Similar to the first exemplary embodiment, after all flow paths have been filled with liquid, the pumps 71 and 78 are operated to form a circulating flow path as illustrated by the arrows of FIG. 7.

Figure 8:
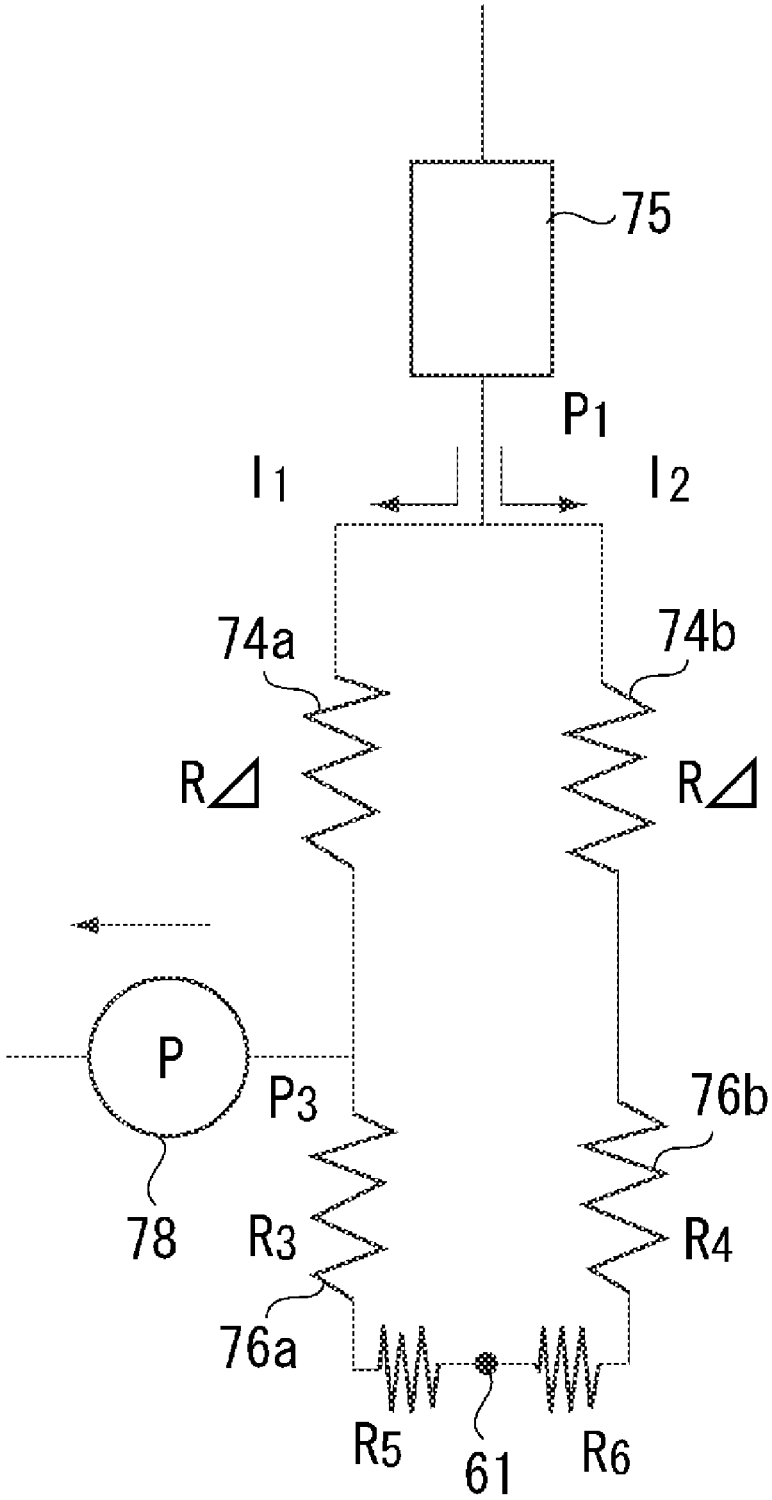
FIG. 8 illustrates flow path resistances according to the second exemplary embodiment.

FIG. 8 schematically illustrates flow path resistances by the flow path configuration according to the present exemplary embodiment. A flow rate $I_1$ is defined by the following formula (4), and a flow rate $I_2$ is defined by the following formula (5):

$$I_1=(P_3-P_1)/R\Delta \tag{4}$$

$$I_2=(P_3-P_1)/(R_3+R_4+R_5+R_6+R_\Delta) \tag{5}$$

where $I_1$ denotes the flow rate in the first branch flow path 74*a*, $I_2$ denotes the flow rate in the second branch flow path 74*b*, $R\Delta$ denotes the flow path resistance of each of the flow paths 74*a* and 74*b*, $R_3$ denotes the flow path resistance of the filter 76*a*, $R_4$ denotes the flow path resistance of the filter 76*b*, $R_5$ denotes the flow path resistance of the individual flow path in the head on the downstream side of the discharge port 61, $R_6$ denotes the flow path resistance of the individual flow path in the head on the upstream side of the discharge port 61, $P_1$ denotes the pressure (Pu) on the downstream side in the vicinity of the negative-pressure maintenance apparatus 75, and $P_3$ denotes the pressure (Pd) on the upstream side in the vicinity of the pump 78.

Actual flow path resistances and dimensions of the liquid discharging apparatus are assigned to formulas (4) and (5). Similar to the first exemplary embodiment, since a flow rate for restraining the dryness in the vicinity of the discharge port is required, a flow rate $I_2$=6 [μl/min] is assumed in the present exemplary embodiment. Since the flow rate is divided by the flow path resistances, a flow rate $I_1$=1130 [ml/min] is obtained. The individual flow paths 68 in the head 13 are similar to those of the first exemplary embodiment. A thousand individual flow paths 68 produce the total flow rate $I_2$. Through measurement, $R_2=R_4$=0.17 [kPa*min/μl] was obtained. Through calculation by the Poisson's law, $R_5+R_6$=7.56×10−4 [kPa*min/μl] was obtained. Through measurement, RΔ=1.81×10−6 [kPa*min/μl] was obtained.

In the present exemplary embodiment, the pump 78 was driven to achieve $P_3$=−4.4 [kPa] and the negative-pressure maintenance apparatus 75 was adjusted to achieve $P_1$=−2.4 [kPa] as values satisfying formulas (1), (4), and (5). On the other hand, the capillary force is about 10 [kPa] similar to the first exemplary embodiment.

Therefore, at the time of non-discharge, the liquid in the flow path is pulled in the downstream direction by a pressure force of −4.4 [kPa](=Pd) and in the upstream direction by a pressure force of −2.4 [kPa](=Pu). Since there is a relation Pu>Pd, the liquid flows from the upstream side to the downstream side.

Figure 9:
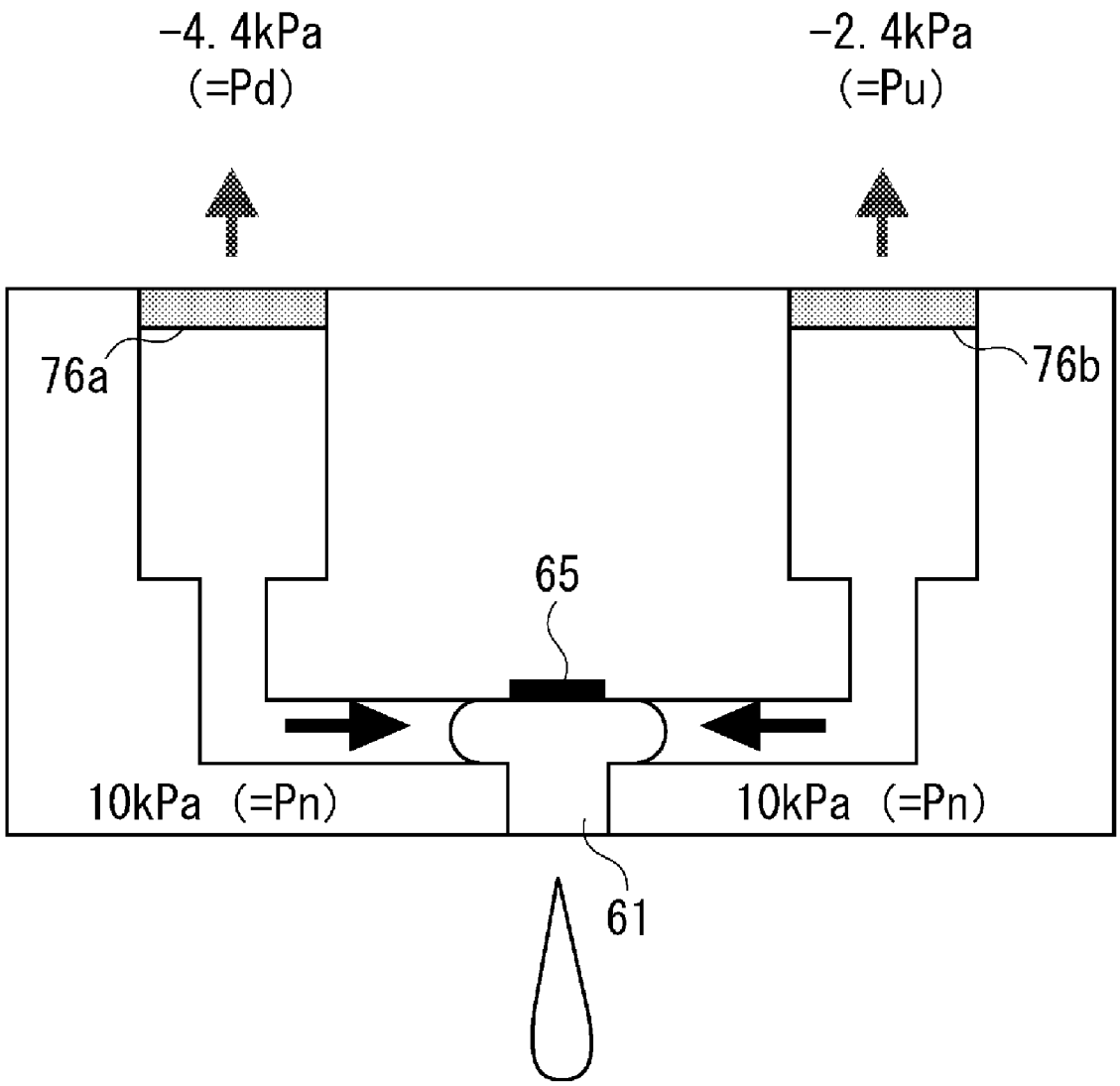
FIG. 9 is a cross-sectional schematic view of a head after liquid discharge according to the second exemplary embodiment.

At the time of refill after discharge, although the liquid in the flow path is pulled in the downstream direction by a pressure force of −4.4 [kPa](=Pd) and in the upstream direction by a pressure force of −2.4 [kPa](=Pu), it is also pulled at the same time toward the side of the discharge port 61 by a pressure force of 10 [kPa](=Pn), as illustrated in FIG. 9. Specifically, since the refill force is larger than the pressure force pulling liquid from the upstream and downstream sides and formula (1) is satisfied, the flow path is refilled with liquid not only from the upstream side of the energy generating element but also from the downstream side thereof.

Further, in the present exemplary embodiment, since the inside of the flow path is maintained at a negative pressure, ink leak from the discharge port 61 can also be suitably restrained. Further, in the present exemplary embodiment, by branching the second supply flow path, the number of flow paths in the head 13 to be refilled with ink increases, enabling the improvement of the refill performance.

A third exemplary embodiment differs from the second exemplary embodiment in the number of negative-pressure maintenance apparatuses 75 and the positions thereof. Descriptions of the configuration and operations similar to those of the above-described exemplary embodiments will be omitted.

Figure 10:
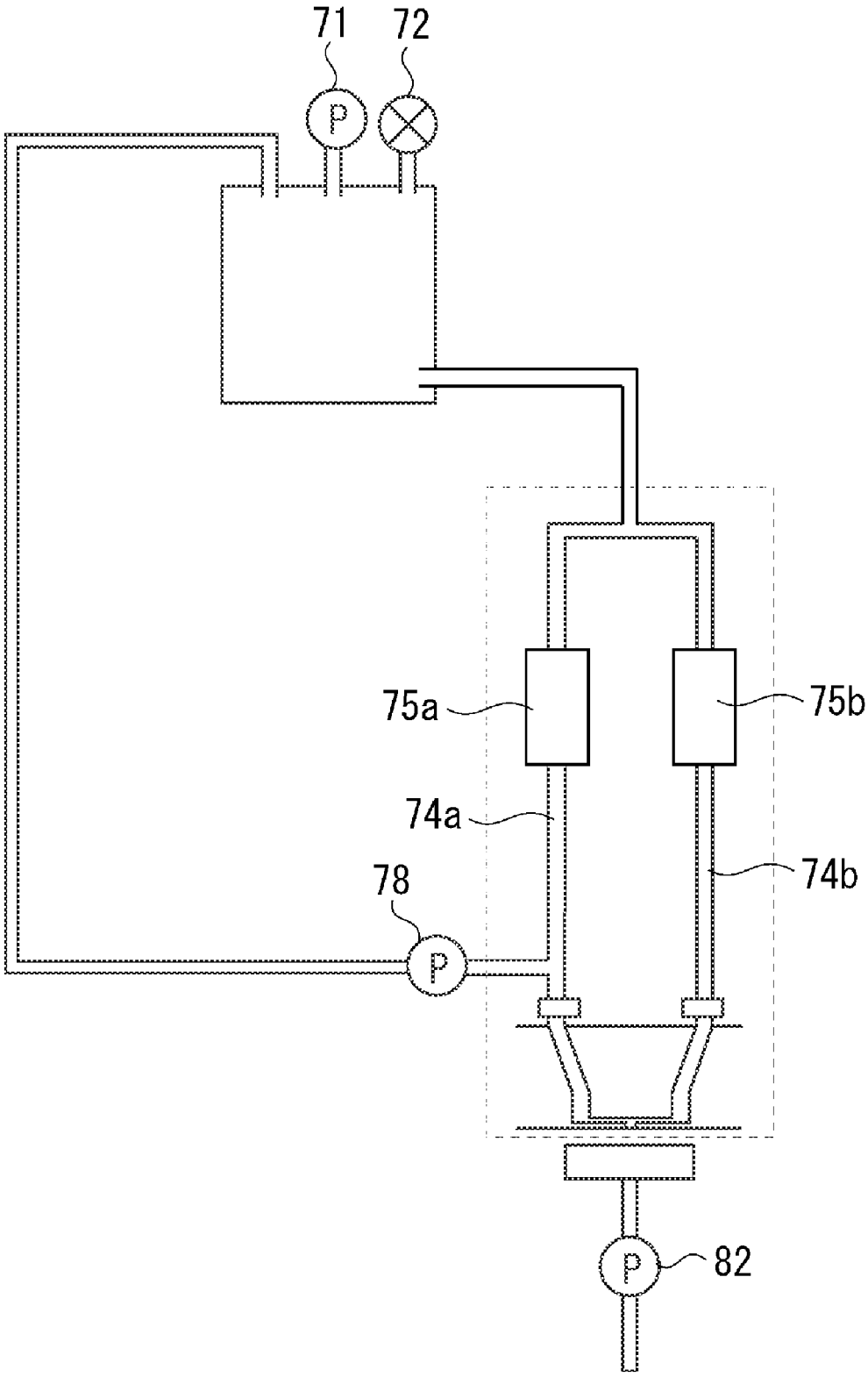
FIG. 10 illustrates a flow path configuration according to a third exemplary embodiment.

FIG. 10 illustrates a flow path configuration of a liquid discharging apparatus according to the present exemplary embodiment with respect to one liquid type. The present exemplary embodiment differs from the second exemplary embodiment in that it includes two negative-pressure maintenance apparatuses 75 generating different negative pressures: a first negative-pressure maintenance apparatus 75*a* disposed in the first branch flow path 74*a*, and a second negative-pressure maintenance apparatus 75*b* disposed in the second branch flow path 74*b*.

Figure 11:
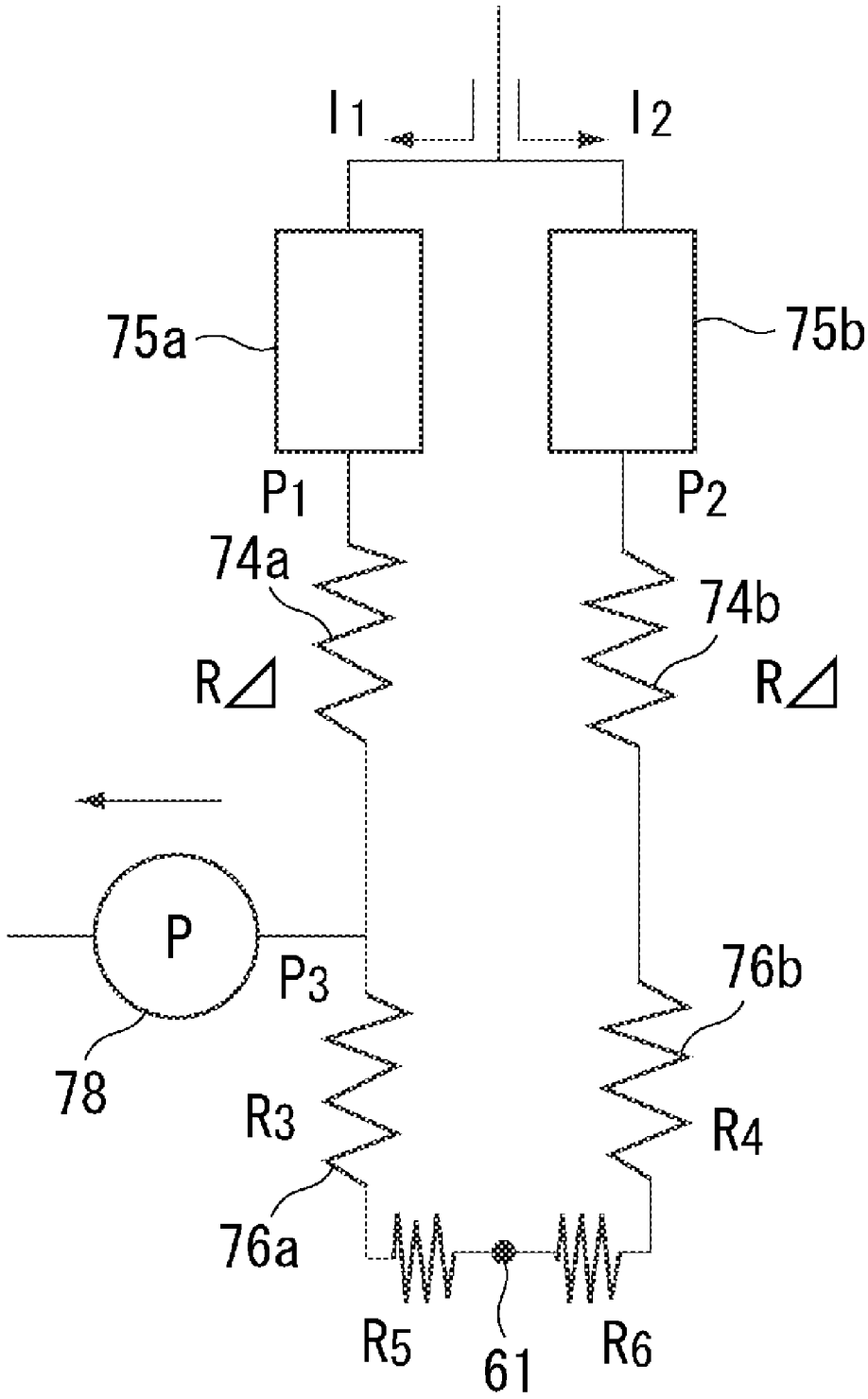
FIG. 11 illustrates flow path resistances according to the third exemplary embodiment.

FIG. 11 schematically illustrates flow path resistances by the flow path configuration according to the present exemplary embodiment. A flow rate $I_1$ is defined by the following formula (6), and a flow rate $I_2$ is defined by the following formula (7):

$$I_1=(P_3-P_1)/R\Delta \quad (6)$$

$$I_2=P_3-P_2)/(R_3+R_4+R_5+R_6) \quad (7)$$

$I_1$ denotes the flow rate in the first branch flow path 74*a*, $I_2$ denotes the flow rate in the second branch flow path 74*b*, $R_\Delta$ denotes the flow path resistance of each of the flow paths 74*a* and 74*b*, $R_3$ denotes the flow path resistance of the filter 76*a*, $R_4$ denotes the flow path resistance of the filter 76*b*, $R_5$ denotes the flow path resistance of the individual flow path in the head 13 on the downstream side of the discharge port 61, $R_6$ denotes the flow path resistance of the individual flow path in the head 13 on the upstream side of the discharge port 61, $P_1$ denotes the pressure on the downstream side in the vicinity of the negative-pressure maintenance apparatus 75*a*, $P_2$ denotes the pressure (Pu) on the downstream side in the vicinity of the negative-pressure maintenance apparatus 75*b*, and $P_3$ denotes the pressure (Pd) on the upstream side in the vicinity of the pump 78.

Actual flow path resistances and dimensions of the liquid discharging apparatus are assigned to formulas (6) and (7). Similar to the second exemplary embodiment, since a flow rate for restraining the dryness in the vicinity of the discharge port 61 is required, a flow rate $I_2$=6 [μl/min] is assumed in the present exemplary embodiment. Since the flow rate is divided by the flow path resistances, a flow rate $I_1$=79.9 [ml/min] is obtained. The individual flow paths 68 in the head 13 are similar to those of the second exemplary embodiment. A thousand individual flow paths 68 produce the total flow rate $I_2$. Through measurement, $R_2=R_4$=0.17 [kPa*min/μl] was obtained. Through calculation by the Poisson's law, $R_5+R_6$=7.56×10−4 [kPa*min/μl] was obtained. Through measurement, $R_\Delta$=1.81×10−6 [kPa*min/μl] was obtained.

In the present exemplary embodiment, the pump 78 was driven to achieve $P_3$=−2.5 [kPa] and both negative-pressure maintenance apparatuses 75 were adjusted to achieve $P_1$=−0.5 [kPa] and $P_2$=−2.4 [kPa] as values satisfying formulas (1), (6), and (7). On the other hand, the capillary force is about 10 [kPa] similar to the second exemplary embodiment.

Therefore, at the time of non-discharge, the liquid in the flow path is pulled in the downstream direction by a pressure force of −2.5 [kPa] (=Pd) and in the upstream direction by a pressure force of −2.4 [kPa] (=Pu). Since there is a relation Pu>Pd, the liquid flows from the upstream side to the downstream side.

Figure 12:
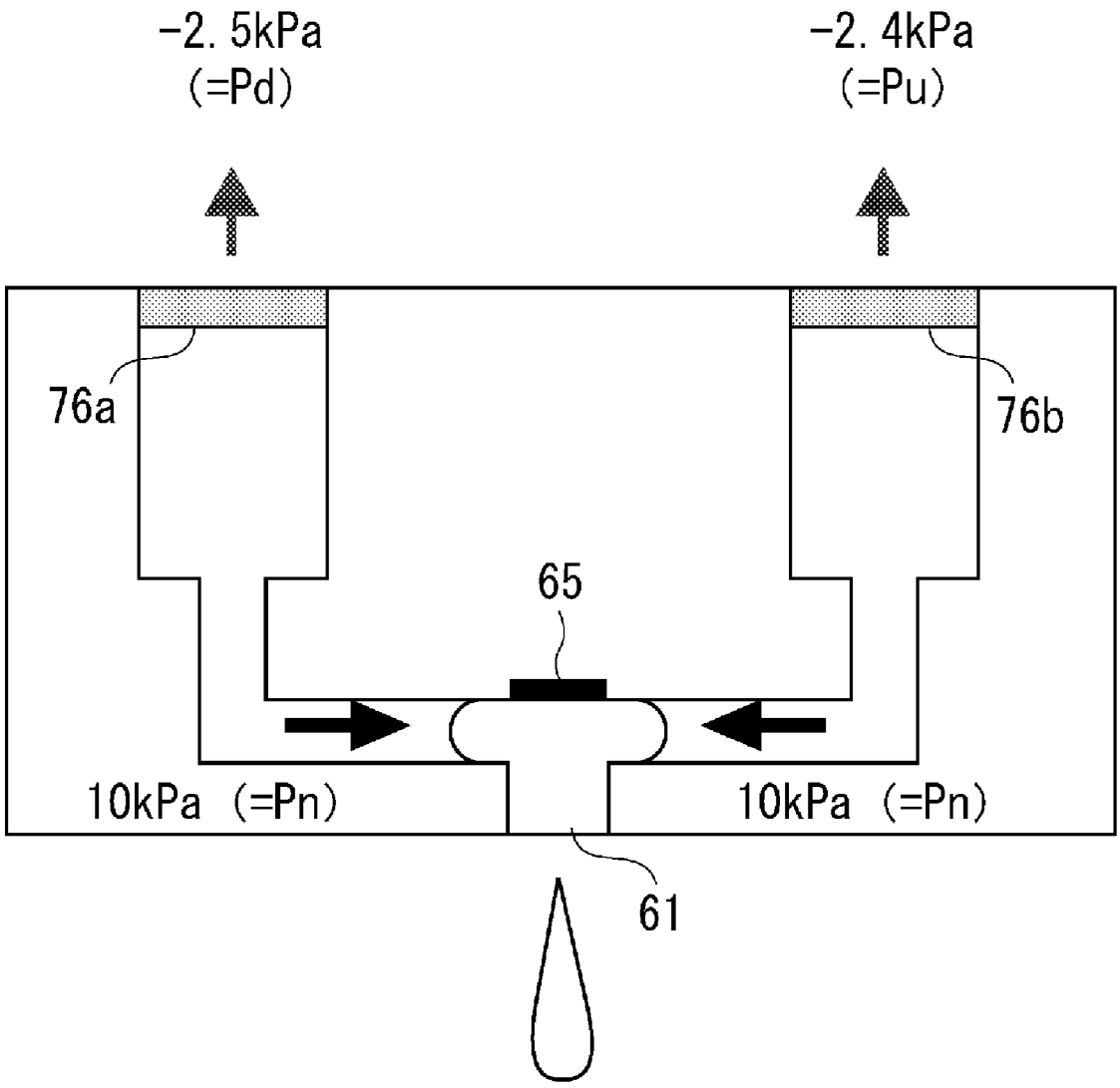
FIG. 12 is a cross-sectional schematic view of ahead after liquid discharge according to the third exemplary embodiment.

At the time of refill after discharge, although the liquid in the flow path is pulled in the downstream direction by a pressure force of −2.5 [kPa] (=Pd) and in the upstream direction by a pressure force of −2.4 [kPa] (=Pu), it is also pulled at the same time toward the side of the discharge port 61 by a pressure force of 10 [kPa] (=Pn), as illustrated in FIG. 12. Specifically, since the refill force is larger than the pressure force pulling liquid from the upstream and downstream sides and formula (1) is satisfied, the flow path is refilled with liquid not only from the upstream side of the energy generating element but also from the downstream side thereof.

Further, in the present exemplary embodiment, the pressure force pulling liquid toward the downstream side of the discharge port 61 is smaller than that in the second exemplary embodiment, refill from the downstream side is easier, thus further improving the refill performance and the straightness of the discharging direction. Further, since the value of $I_1+I_2$, i.e., the flow rate required by the pump 78 can be largely reduced in comparison with the first exemplary embodiment, enabling the improvement in overall energy efficiency.

Performing each of the above-described exemplary embodiments allows the discharge operation and refill operation while driving the pump 78, i.e., while circulating liquid in the flow path. As a result, liquid can be discharged while preventing the dryness of the liquid by circulation.

Further, when the relation between the pressure in the flow path on the upstream side (flow path from the negative-pressure maintenance apparatus 75 to the discharge port 61) and the pressure in the flow path on the downstream side (flow path from the discharge port 61 to the negative-pressure maintenance apparatus 75) satisfies formula (1), formula (1) is also satisfied in the vicinity of the discharge port 61 and the energy generating element. In other words, it is only necessary that a pressure $P_1$ in the vicinity of the negative-pressure maintenance apparatus 75 and a pressure $P_3$ in the vicinity of the pump 78 satisfy formula (1). The pressures $P_1$ and $P_3$ can be measured by a pressure gauge disposed in the flow path.

Figure 13:
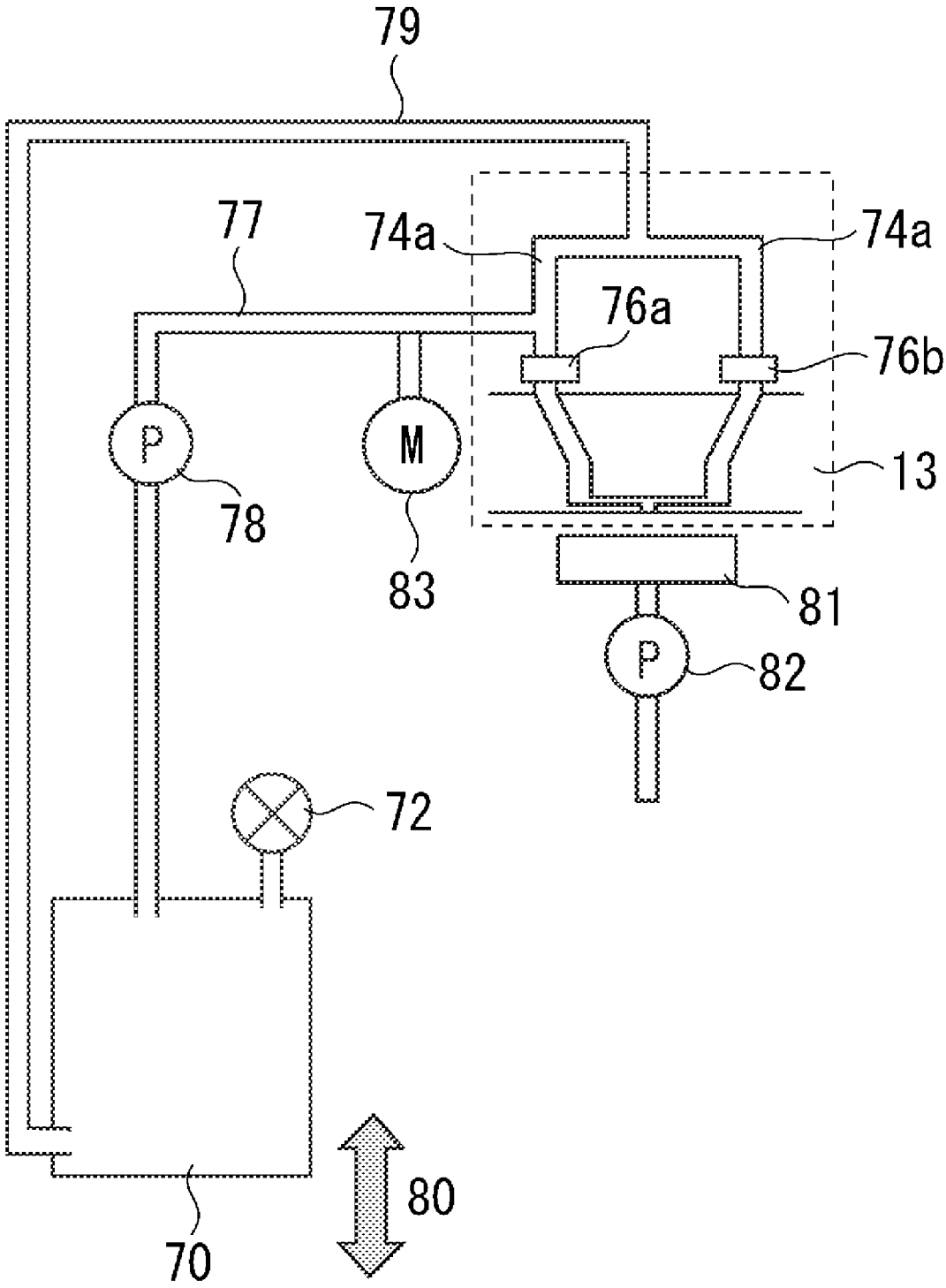
FIG. 13 illustrates a flow path configuration according to a fourth exemplary embodiment.

In the third exemplary embodiment, pressures in the flow path are controlled by using the negative-pressure maintenance apparatus 75 and the pump 78 disposed downstream of the head 13 as a pressure adjustment unit. In a fourth exemplary embodiment, the pressure in the head 13 is controlled by vertically moving the position of the liquid container 70, as illustrated in FIG. 13. Descriptions of the configuration and operations similar to those of the third exemplary embodiment will be omitted.

A liquid container vertical movement drive mechanism 80 is preferably used to vertically move the position of the liquid container 70. The vertical drive mechanism 80 is, for example, an ordinary rack, a pinion-type movement stage, etc. The pressure at an upstream position of the pump 78 in the collecting flow path 77 disposed downstream of the head 13 is measured by a pressure gauge 83, and the pressure in the first supply flow path 79 disposed upstream of the head 13 is measured by a pressure gauge (not illustrated).

These pressure values control the amount of vertical movement of the liquid container 70 so that formula (1) is satisfied. Thus, it becomes possible to reliably control the inside of the flow path to a desired pressure regardless of variation in maintained pressure due to dimensional tolerance of the negative-pressure maintenance apparatus 75 and environmental changes.

Figure 14:
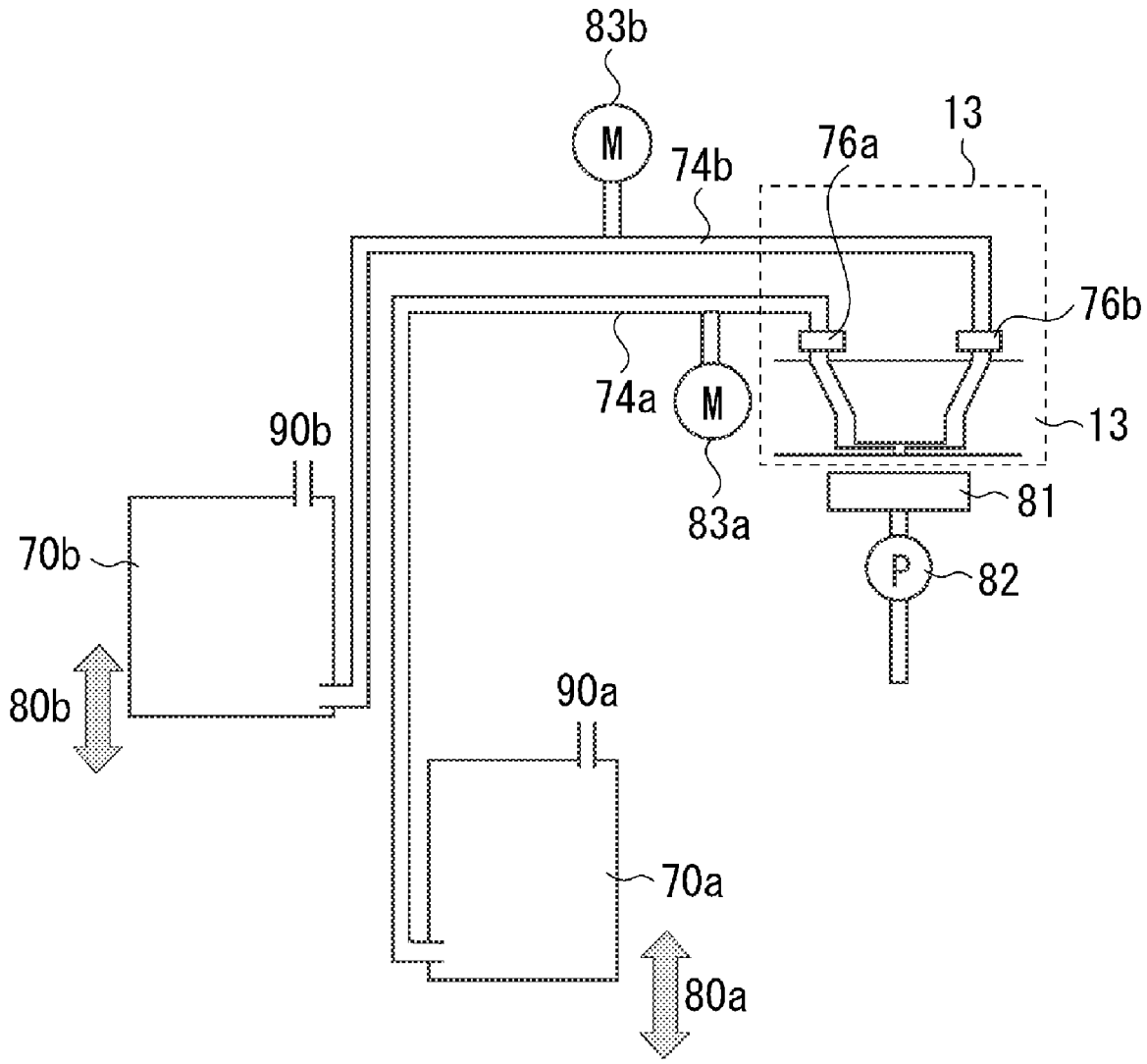
FIG. 14 illustrates a flow path configuration according to a fifth exemplary embodiment.

In the first exemplary embodiment, pressures in the flow path are controlled by using a set of the negative-pressure maintenance apparatus 75 and the pump 78 as a pressure adjustment unit. In a fifth exemplary embodiment, the pressure in the head 13 is controlled by vertically moving the position of two liquid containers: a first liquid container 70*b* and a second liquid container 70*a*, as illustrated in FIG. 14. Descriptions of the configuration and operations similar to those of the above-described exemplary embodiments will be omitted.

The liquid container 70*a* and 70*b* are provided with atmosphere communication ports 90*a* and 90*b*, respectively. Similar to the third exemplary embodiment, liquid container vertical movement drive mechanisms 80*a* and 80*b* are used to vertically move the positions of the liquid containers 70*a* and 70*b*, respectively.

In the present exemplary embodiment, the pressure in the flow path 74*b* for supplying liquid to the head 13 is measured by a pressure gauge 83*b* disposed upstream of the head 13, and the pressure in the flow path 74*a* for collecting liquid from the head 13 is measured by a pressure gauge 83*a* disposed downstream of the head 13. These pressure values control the amount of vertical movement of the liquid containers 70*a* and 70*b* so that formula (1) is satisfied.

In the present exemplary embodiment, the direction of liquid flow can be changed by the relation between the amounts of liquid contained in each of the two liquid containers 70*a* and 70*b*. First of all, the liquid container 70*b* containing a larger amount of liquid serves as the upstream side. Liquid is circulated from the liquid container 70*b* to the second flow path 74*b*, the head 13, and the first flow path 74*a*, and then collected into the liquid container 70*a*.

With this liquid circulation, the amount of liquid in the liquid container 70*b* decreases to an almost empty state, while the amount of liquid in the liquid container 70*a* increases. Then, the liquid is circulated in opposite direction, i.e., from the liquid container 70*a* to the first branch flow path 74*a*, the head 13, and the second branch flow path 74*b*, and then collected into the liquid container 70*b*.

To change the direction of liquid flow, the liquid level in one liquid container serving as the upstream side may be brought to a higher position than the liquid level of the other liquid container serving as the downstream side. Further, to maintain a constant flow rate of liquid, the relation in height between the liquid containers 70*a* and 70*b* may be controlled so that the difference between the liquid levels of the two liquid containers is maintained constant.

This process of controlling the height of the liquid containers 70*a* and 70*b* may be continued until both liquid containers run out of liquid. Thus, liquid can be circulated in the head 13 without using the pump 78. The above-described process is possible because the flow path between the liquid container 70*a* and the head 13 and the flow path between the liquid container 70*b* and the head 13 are symmetrical.

Further, since the pressure force pulling liquid to the downstream side is smaller than that in the fourth exemplary embodiment, it is easy to refill the flow path with liquid from the downstream side, enabling the improvement of the refill performance and the straightness of the discharging direction.

Although a negative pressure is applied from both the upstream and downstream sides of the energy generating element in anyone of the above-described exemplary embodiments, it may be also possible to apply a positive pressure from both the upstream and downstream sides, or apply a positive pressure from the upstream side and a negative pressure from the downstream side. In either case, as long as liquid does not leak from the discharge port 61 at the time of non-discharge, the pressure in the head 13 does not necessarily be a negative pressure but may be a positive pressure.

Further, in any one of the above-described exemplary embodiments, since the flow path can be refilled with liquid from both the upstream and downstream sides of the discharge port 61 and relevant energy generating element, it becomes possible to ensure a sufficient refill speed allowing high discharge frequencies to be applied.

Further, refill from two directions (two paths) achieves more symmetric refill operation on the energy generating element than conventional refill from one direction (one path), improving the straightness of the discharging direction.

Further, liquid flows very slowly at the time of non-discharge. Therefore, when dust or bubbles enter the flow path, it becomes possible to restrain pressure change in the vicinity of the discharge port 61 due to variation in flow path resistance. Thus, the discharge performance can be favorably maintained while restraining the thickening and solidification of liquid due to the evaporation of the liquid from the discharge port 61 (for example, volatile component of ink).

According to each of the exemplary embodiments of the present invention, it becomes possible to ensure reliable discharge while restraining the thickening and solidification of liquid due to the evaporation of the liquid in the vicinity of the discharge port 61.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-155676 filed Jun. 30, 2009, which is hereby incorporated by reference herein in its entirety.

What is claimed is:

1. A liquid discharging apparatus comprising:

a liquid container configured to contain a liquid;

an energy generating element used to discharge the liquid from a discharge port;

a supply flow path configured to supply the liquid from the liquid container to the energy generating element;

a negative-pressure maintenance unit provided in the supply flow path;

a collecting flow path configured to collect the liquid from the energy generating element into the liquid container;

a pump provided in the collecting flow path; and a control unit configured to control the negative-pressure maintenance unit and the pump, the control unit adjusting Pu and Pd so that a condition "Pu>Pd, Pn>−Pd" is satisfied, where Pu denotes a pressure in a flow path on the upstream side of the energy generating element, Pd denotes a pressure in the flow path on the downstream side of the energy generating element, and Pn denotes a pressure equivalent to a capillary force for refilling the flow path with the liquid when the liquid has been discharged from the discharge port.

2. The liquid discharging apparatus according to claim 1, wherein the supply flow path branches to first and second branch flow paths, and wherein the first branch flow path is connected to the collecting flow path, and the second branch flow path is configured to supply the liquid from the liquid container toward the energy generating element.

3. The liquid discharging apparatus according to claim 2, wherein the pressure adjustment unit includes a negative-pressure maintenance apparatus provided between the liquid container and a branch point of the first and second branch flow paths, and a pump provided in the collecting flow path.

4. The liquid discharging apparatus according to claim 2, wherein the pressure adjustment unit includes a negative-pressure maintenance apparatus provided in each of the first and second branch flow paths, and a pump provided in the collecting flow path.

5. The liquid discharging apparatus according to claim 2, wherein the pressure adjustment unit includes a drive mechanism configured to vertically move the liquid container.

* * * * *